US006098516A

United States Patent [19]

Gazonas

[11] Patent Number: 6,098,516

[45] Date of Patent: Aug. 8, 2000

[54] LIQUID GUN PROPELLANT STIMULATION

[75] Inventor: George A. Gazonas, Bel Air, Md.

[73] Assignee: The United States of America as represented by the Secretary of the Army, Washington, D.C.

[21] Appl. No.: 08/816,751

[22] Filed: Feb. 25, 1997

(Under 37 CFR 1.47)

[51] Int. Cl.[7] ..... F42B 3/00

[52] U.S. Cl. ..... 86/20.15; 102/312; 102/313; 181/401

[58] Field of Search ..... 102/312, 313; 86/20.15; 181/401

[56] References Cited

U.S. PATENT DOCUMENTS

| | | | |
|---|---|---|---|
| 4,074,629 | 2/1978 | Colgate | 102/23 |
| 4,103,756 | 8/1978 | Tralio et al. | 181/401 X |
| 4,685,375 | 8/1987 | Ross et al. | 86/20.15 |
| 4,966,077 | 10/1990 | Halliday et al. | 102/313 |
| 5,099,763 | 3/1992 | Coursen et al. | 102/313 |
| 5,192,819 | 3/1993 | Baumgartner | 86/20.15 |
| 5,232,526 | 8/1993 | Willer et al. | 149/45 |
| 5,308,149 | 5/1994 | Watson et al. | 102/313 X |
| 5,491,280 | 2/1996 | Brummond et al. | 588/202 |
| 5,607,181 | 3/1997 | Richardson et al. | 280/737 |

*Primary Examiner*—Peter A. Nelson
*Attorney, Agent, or Firm*—Paul S. Clohan, Jr.; William E. Eshelman

[57] ABSTRACT

To increase a yield of a hydrocarbon such as oil from a subsurface reservoir, the reservoir is stimulated by pumping liquid gun propellant (LP) into the reservoir and igniting the LP. The LP is pumped into a packed-off region in a cased well; the depth of the packed-off region is selected to lie within the reservoir. The ignition of the LP causes a pressurization of the reservoir, thus fracturing the reservoir. The fracture increases a surface area through which the hydrocarbon can be extracted, and the heat from the ignition reduces the viscosity of the hydrocarbon.

9 Claims, 4 Drawing Sheets

LIQUID GUN PROPELLANT STIMULATION

FIELD OF INVENTION

The present invention is directed to a method and system for stimulating subsurface hydrocarbon reservoirs by surface injection of a liquid gun propellant (LP) for enhanced oil recovery (EOR).

DESCRIPTION OF THE RELATED ART

The exploitation of hydrocarbons in subsurface reservoirs typically occurs in three stages, which are termed primary, secondary and tertiary. As the world's oil resources shrink, oil companies have become increasingly dependent upon secondary and tertiary hydrocarbon recovery methods that are known in the industry as enhanced oil recovery (EOR) stimulation methods. Such methods typically involve injecting a treatment fluid down a well to create a hydraulic fracture. In such methods, in situ combustion (fireflooding) is sometimes used.

The decision regarding which recovery technique is used in a particular reservoir is generally relegated to a petroleum engineer, who makes his decision based upon many factors, which include the characteristics of the reservoir such as permeability, depth, geometry, age, the hydrocarbon trapping mechanism (i.e. sedimentary or structural), whether the field is onshore or offshore, the type of hydrocarbon, and the physical characteristics (e.g. viscosity) and purity of the hydrocarbon. Another important factor which governs the method of recovery is cost, since the cost to produce the hydrocarbon should be less than the projected return due to sales.

Evidence for the success of a particular stimulation is usually provided by using computer-based reservoir stimulators that rely upon information about the wave geometry and physical properties of the reservoir as well as the physical properties of the hydrocarbon resource that is to be extracted from the reservoir.

Treatment fluids and pumping schedules used for resource recovery are also highly specialized, and more often than not, the treatment schedules and fluid properties for a particular stimulation are proprietary. The earth's overburden pressure gradient and pore pressure gradient are about 1 psi/ft and 0.5 psi/ft respectively, so that for an oil reservoir at 1000 ft depth, the downhole pressure required to propagate a horizontally oriented hydraulic fracture is about 500 psi. The downhole pressure is maintained by mechanically pumping the treatment fluids down the wellbore from the earth's surface. Typical volumetric pumping rates for treatment fluids vary greatly but are on the order of one barrel/min (158 liters/min). Treatment fluids include water and sand-laden HPG (hydroxypropyl guar) gels for hydraulic fracture stimulations, superheated steam for steam-floods for huff-and-puff stimulations, and an oxidant gas for fire-flood stimulations.

STATEMENT OF THE INVENTION

It is an object of the present invention to provide an EOR stimulation method and system which increase the downhole pressure over that which can be achieved by the prior art, thereby augmenting the creation of massive hydraulic fractures.

It is a further object of the present invention to provide such an EOR stimulation method and system in which both a fuel and an oxidizer are present downhole, so that when fireflooding is used, it is not necessary to rely on the hydrocarbon itself as a fuel.

To achieve these and other objects, the present invention is directed to a method and system for stimulating subsurface hydrocarbon reservoirs by surface injection of a propellant comprising both a fuel and an oxidizer, such as a liquid gun propellant (LP), down a cased well and subsurface ignition at a selected point and depth in the earth. The fluid pressure created by the injection of the propellant serves to initially hydraulically fracture the reservoir, as in standard hydrofracture methods that use, for example, water or cross-linked hydroxypropyl guar (HPG) gels as the fracturing fluid. In the present invention, however, subsequent ignition and combustion of the propellant at depth augment pressurization within the fracture cavity and cause it to propagate outward into the reservoir. The increased pressurization at depth, above that which is realizable by surface pumping of noncombustible fluids, serves to increase the efficiency of the hydraulic fracture treatment. Further, the heat generated by the burning propellant serves to decrease the hydrocarbon viscosity through convective and conductive heat transfer to the formation; this heating promotes subsequent recovery of the hydrocarbon. The invention is applicable, but not limited, to creating (i) massive hydraulic fractures in relatively impermeable "tight-gas" sands, (ii) in situ combustion (fireflood) stimulations in heavy oil deposits, and (iii) steam-flood (huff and puff) tar-sand stimulations. The invention is especially applicable to fireflood applications, since LPs (e.g., TEAN (triethanolammonium nitrate, $C_3H_6N_2O_6$ fuel)) contain a miscible oxidizer (e.g., HAN (hydroxylammonium nitrate, $N_2H_2O_4$)) and do not require injection of an oxidant gas downhole to sustain combustion of the flame front. The mechanics and physics of subsurface EOR processes using LP are analogous, in many respects, to the physics of gun interior ballistics; therefore, in real-time monitoring of the propagation of a fracture caused by an EOR process using LP, a gun interior ballistic model may be used.

By using a propellant compromising both a fuel and an oxidizer as the treatment fluid in EOR processes, both mechanical pumping and combustion of the propellant will be used to generate the pressure needed to propagate the hydraulic fracture. Ultimate control of the propellant-induced stimulation preferably employs real-time feedback obtained from a variety of sensor technologies. A number of different methods for mapping the subsurface movement of the stimulation and controlling its effectiveness are available, e.g., using geotomographic methods, electromagnetic methods (CSAMT), seismic and microseismic methods, tiltmeter surveys, tracer movement and pressure transient analysis; these methods are to be used for mapping the progression of the stimulation. Modified gun interior ballistics simulators can replace reservoir simulators for pressure transient analysis.

LPs are attractive for use in guns because of their higher energy density relative to granular solid propellants. In an analogous fashion, the subsurface combustion of a high energy density LP augments the creation of massive hydraulic fractures by increasing the downhole pressure above that realizable through surface pumping alone. Furthermore, in situ combustion (fireflooding) using LP provides both a fuel and an oxidizer downhole; the present invention therefore does not solely rely upon the hydrocarbon itself as a fuel for the combustion and a continuous supply of surface oxidant gas to maintain the combustion front. Furthermore, the efficiency of convective and conductive heat transfer from the burning LP to the hydrocarbon reservoir is increased through creation of a Kelvin-Helmholtz instability; the heat transfer to the formation thus reduces the hydrocarbon's viscosity and promotes subsequent recovery of the hydrocarbon. Moreover, interior ballistic simulators used for the prediction of the exit velocity of kinetic energy projectiles can be modified and used as reservoir simulators, since the motion of the projectile in a gun is in many ways analogous to the propagation of the leading edge of a hydraulic fracture. In addition, the expansion of the gun tube during firing is mechanically similar to the separation of the fracture surfaces of an hydraulically induced fracture. Finally, the unwetted portion of the hydraulic fracture in the vicinity of its leading edge is analogous to the ullage region at the base of the projectile.

Since LP is designed to be invulnerable to a variety of threats in the battlefield environment, such as hot fragment impact ignition and shaped charge jet impact, this characteristic assures its safe use in the relatively benign oilfield environment. In addition, the hazard classification of most LPs is 1.3 (mass burning); hence, LPs are much safer to use than explosive slurry mixtures (hazard classification 1.1., i.e. mass detonating) which are used in some in situ oil shale retort operations. Furthermore, explosive slurries detonate at depth and rubblize the formation that is near the wellbore, whereas the present invention creates one or more large hydraulic fractures that propagate out into the formation and thereby are able to drain a larger portion of the reservoir. Since the ingredients of the LP can be mixed on site, it is not necessary to transport hazardous material through populated areas.

The basic properties of LPs are known to those skilled in the art as evidenced, e.g., by *Liquid Propellant* 1846 *Handbook*, JPL D-8978 Review Draft, March, 1992. However, the use of LPs in the method and system according to the present invention is not found in the prior art.

BRIEF DESCRIPTION OF THE DRAWINGS

A preferred embodiment of the present invention will now be set forth in detail with reference to the drawings, in which.

DETAILED DESCRIPTION OF THE PREFERRED EMBODIMENT

Figure 1:
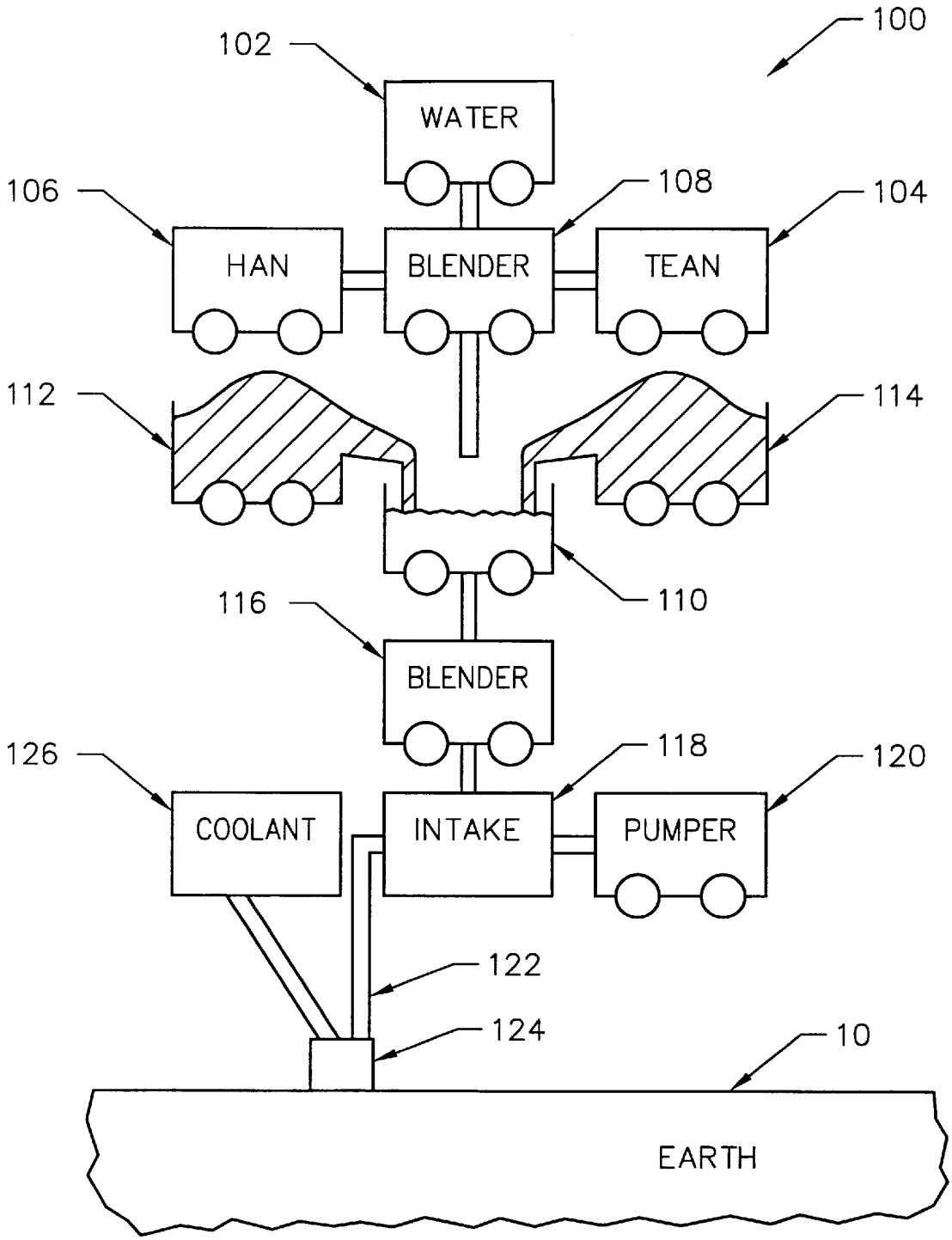
FIG. 1 shows an above-ground portion of a system according to the preferred embodiment of the present invention.

FIG. 1 shows above-ground portion 100 of a system according to the preferred embodiment of the present invention using a liquid gun propellant. Various components are shown as wheeled, although they could also be conveyed to a site in other ways as needed. Water from storage tank 102, HAN (hydroxylammonium nitrate, $N_2H_2O_4$) from storage tank 106 and TEAN (triethanolammonium nitrate, $C_3H_6N_2O_6$) from storage tank 104 are mixed in primary blender 108, and the resulting LP is output to holding tank 110. If proppant is to be added to the LP at this stage, a proppant such as sand from hopper 112 or glass beads from hopper 114 can be added, and the resulting mixture can be re-blended in the secondary blender 116. The LP mixture from blender 116 is drawn into intake manifold 118, from which pumper 120 forces it through stainless steel tubing 122 into well head 124 formed in earth 10. Coolant 126 may also be added as needed.

Figure 2:
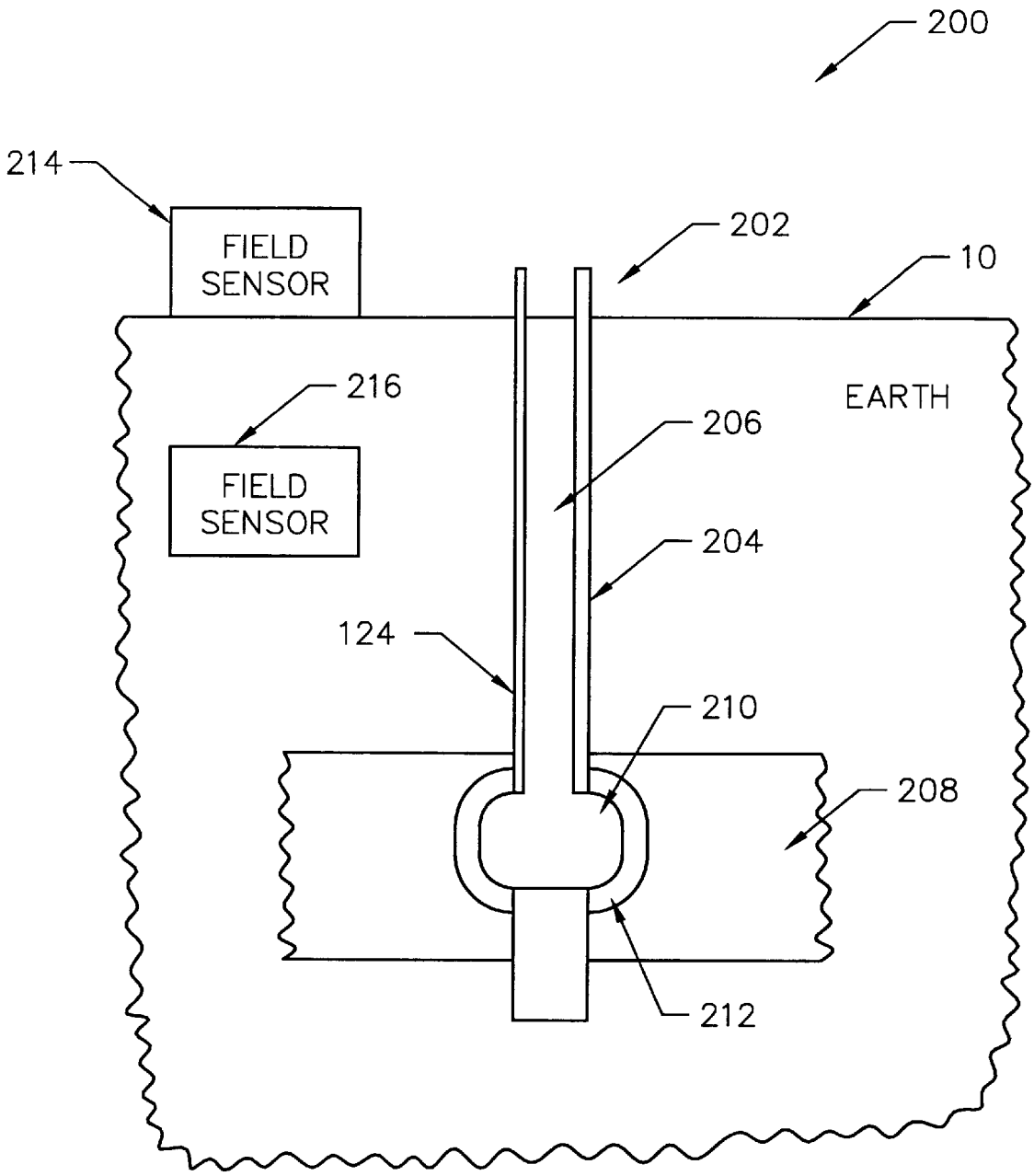
FIG. 2 shows a below-ground portion of the system according to the preferred embodiment.
Figure 3:
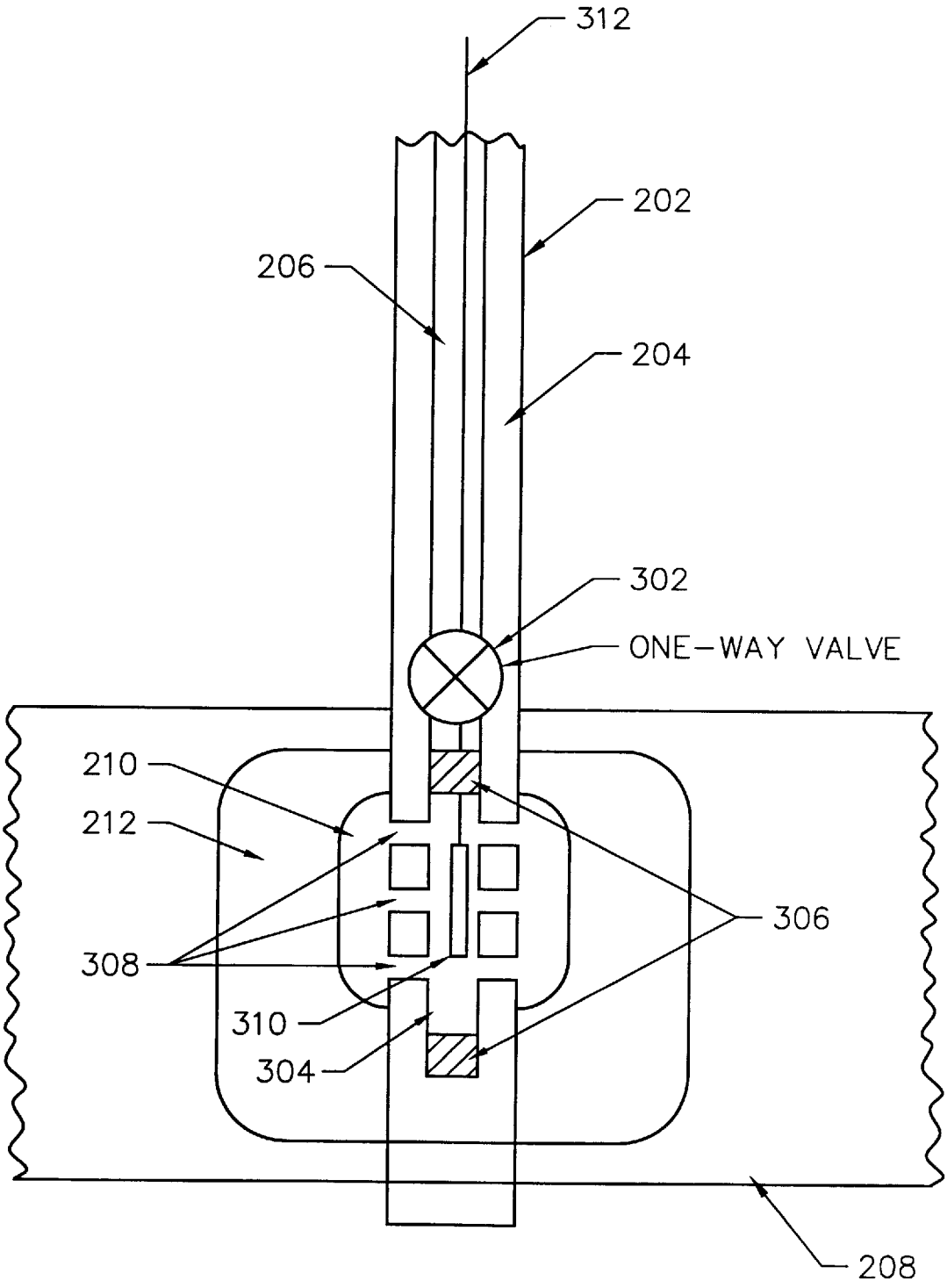
FIG. 3 shows details of a portion of the below-ground portion shown in FIG. 2.

FIGS. 2 and 3 show below-ground portion 200 of the system according to the preferred embodiment. Well head 124 leads to cased well 202 with casing 204. Cased well 202 extends into earth 10 at least as far as oil or gas reservoir formation 208. LP mixture 206 is pumped into well 202 and passes through one-way flow valve 302 to region 304 formed by non-combustible packer material 306. From region 306, LP mixture 206 enters formation 208 through perforations 308 in well casing 204. The fluid pressure created by the injection of the LP initially hydraulically fractures the reservoir to create mini-fracture locus 210. LP mixture 206 is then ignited by igniter 310 which is controlled from the surface through wire line 312. This ignition and combustion of the LP augments pressurization within the mini-fracture locus 210 to create a subsequent fracture locus 212.

The quality of LP mixture 206 is selected in accordance with the properties of formation 208 and of the hydrocarbon resource therein. LP mixture 206 is pumped at sufficient pressure and rate to hydraulically fracture formation 208 at a preselected depth and position. Pumping rates for the LP Monergol have exceeded 100 liters/min using high speed centrifugal pumps for a period of a day with no discernible chemical stability or ballistic problems; this pumping rate is about the same order of magnitude as in current hydraulic fracture treatments using conventional noncombustible fracturing fluids.

As noted above, the total volume of LP to be pumped into formation 208 will depend upon the size of the hydraulic fracture to be created. A typical rectangular fracture with dimensions of 0.1 ft in width and 300 ft in length and height requires a conventional noncombustible fracturing fluid volume of 254,880 liters, assuming no leakoff. Using LP as the fracturing fluid, however, much less fluid will be required, since the mechanical energy required to open and propagate the fracture at depth will be provided by the pressurization of the fracture cavity as the LP burns and the combustion gases expand into the fracture cavity.

Experiments have shown that pressures on the order of several hundred megapascals are achievable during the combustion of LP in closed-bomb pressure vessels on the order of a liter in volume. This pressure is more than sufficient to initially fracture the formation at depth and propagate the hydraulic fracture some distance into the formation. In rare circumstances, it is anticipated that the viscous LP that travels down the tubing may prematurely ignite due to frictional heating as a result of high Reynold's number flow; premature ignition will depend upon many factors including LP density, viscosity, pumping rate, and tubing diameter. Several ways to prevent premature ignition of the LP are by decreasing the pumping rate or increasing the tubing diameter or by pumping a subsidiary coolant such as liquid $N_2$ or $CO_2$ into the wellbore from the surface to surround and cool the LP as it travels down the tubing. The pressure within the fracture cavity increases when the LP begins to burn until the formation fracture toughness is exceeded, whereupon the hydraulic fracture begins to propagate into the reservoir. Heat transfer from the burning LP serves to soften and reduce the viscosity of the reservoir hydrocarbon which will promote subsequent recovery of the hydrocarbon resource. For fireflood applications and the creation of massive hydraulic fractures, LP can be continuously injected as it burns through the one-way flow valve. For other types of stimulations however, such as huff-and-puff stimulations, LP can be pumped, ignited, burned and then the hydrocarbon can be subsequently recovered; this sequence can be repeated many times in a cyclic hydrocarbon recovery sequence common to huff-and-puff stimulations although LP will be used instead of superheated steam as the agent that reduces the hydrocarbon viscosity.

The preferred embodiment can be modified in manners such as the following. The LP can be any of the following LPs or others: an aqueous monopropellant such as nitromethane, $CH_2NO_2$, and hydrogen peroxide, $H_2O_2$; a multicomponent monopropellant containing hydroxylammonium nitrate, $N_2H_4O_4$ (HAN), as an oxidizer, trethanolammonium nitrate, $C_6H_{16}N_2O_6$ (TEAN) and water, $H_2O$, as the fuel; an OTTO fuel or dinitroxypropane, $C_3H_6N_2O_6$ and diethylsebacate as the diluent. The LP used is determined and optimized for a particular EOR stimulation. EOR stimulations such as (i) the formation of hydraulic fractures, (ii) in situ combustion (fireflooding) or (iii) huff-and-puff superheated steam types of stimulation can be used as needed. The cycle of pumping and ignition can be performed once or repeated an indefinite number of times. Pumping can be stopped before ignition commences or continued during ignition. Real-time movement of the LP hydraulic fracture or the EOR stimulation can be controlled through real-time feedback from field sensors such as field sensors 214 and 216; such field sensors can be those used in geotomographic methods, magnetic methods, electromagnetic methods (CSAMT), seismic and microseismic methods, tiltmeter surveys, tracer movement or pressure transient analysis. If pressure transient analysis is used, it can be performed using either a modified gun interior ballistic simulator or a reservoir simulator. Of course, the modifications noted above and others can be combined as needed.

Figure 4:
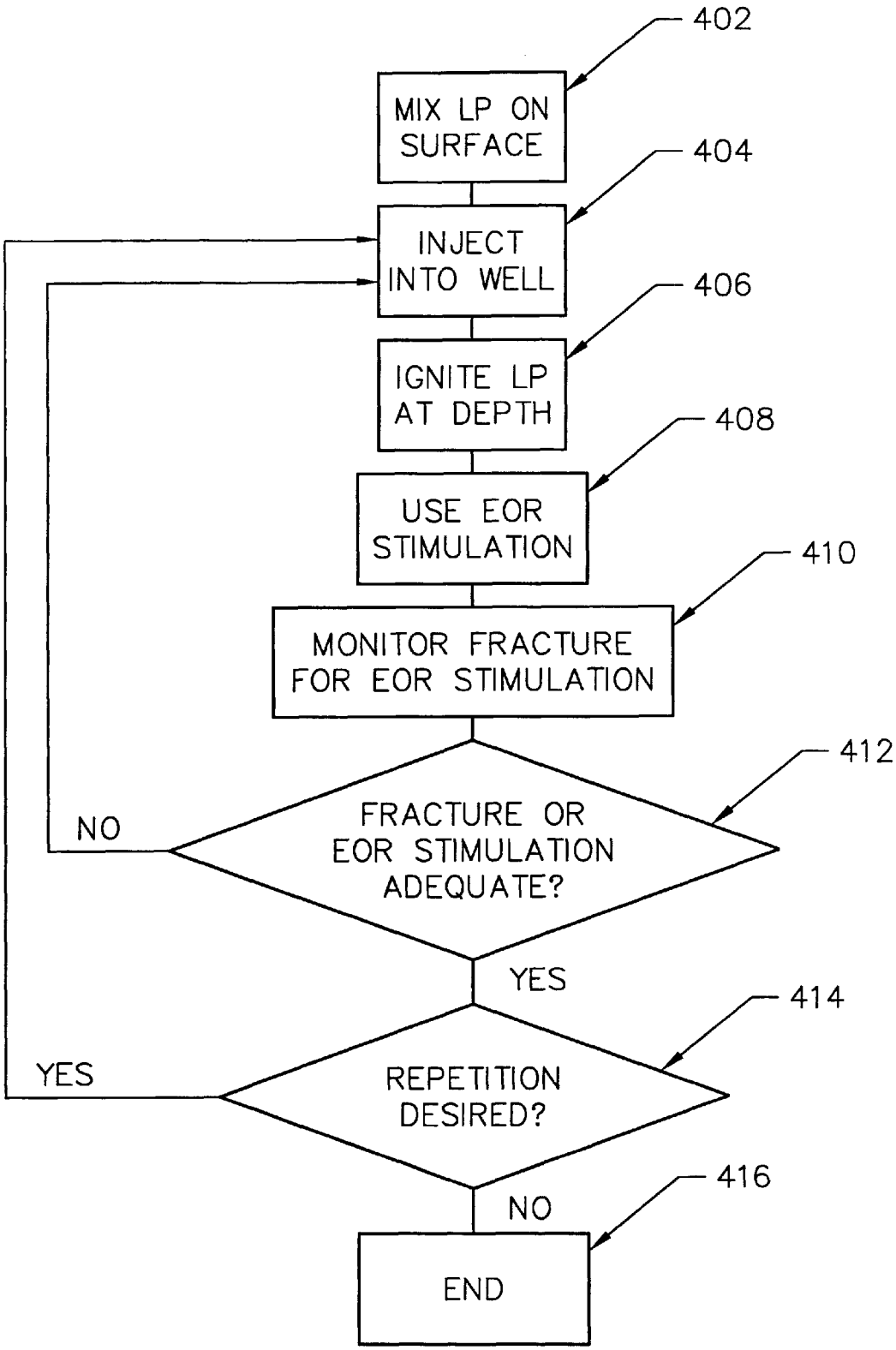
FIG. 4 shows a flow chart of operation of the system of FIGS. 1–3.

FIG. 4 shows a flow chart of the operations described above. In step 402, the LP is mixed in this surface. In step 404, it is injected into this well. In step 406, the LP is ignited at depth. In step 408, EOR stimulation is used. In step 410, the fracture or EOR stimulation is monitored. And in step 412, it is determined whether the fracture or EOR stimulation is adequate; if not, more LP is injected into the well. In step 414, it is determined whether to repeat the above operations; if not, the entire operation of the system is ended in step 416. It will be clear from the preceding discussion that some of the above steps will be unnecessary in certain cases and can therefore be omitted.

While a preferred embodiment and certain modifications have been set forth above, it will be readily apparent to those skilled in the art who have reviewed this disclosure that other modifications can be made within the scope of the present invention. Therefore, the present invention should be construed as limited only by the appended claims.

We claim:

1. A method of stimulating a subsurface hydrocarbon reservoir penetrated by a well, the method comprising:

(a) preparing a liquid gun propellant which comprises both a fuel and an oxidizer;

(b) injecting the liquid gun propellant into the well to a sufficient depth so that the liquid gun propellant reaches the subsurface hydrocarbon reservoir; and (c) igniting the liquid gun propellant in the subsurface hydrocarbon reservoir.

2. A method as in claim 1, wherein the liquid gun propellant comprises hydroxylammonium nitrate ($N_2H_2O_4$), triethanolammonium nitrate ($C_3H_6N_2O_6$) and water.

3. A method as in claim 1, wherein the liquid gun propellant is prepared at an above-ground location.

4. A method as in claim 1, wherein step (b) is continued while step (c) is performed.

5. A method as in claim 1, wherein the well has a packed-off region in the subsurface hydrocarbon reservoir, and wherein step (b) comprises pumping the liquid gun propellant into the packed-off region.

6. A method as in claim 5, wherein the well comprises a one-way valve leading into the packed-off region, and wherein step (b) comprises pumping the liquid gun propellant into the packed-off region through the one-way valve.

7. A method as in claim 1, further comprising:

(d) tracking, by use of at least one field sensor, a movement of a fracture or enhanced oil recovery stimulation caused in the subsurface hydrocarbon reservoir as a result of step (c); and (e) regulating the amount of liquid gun propellant injected into the well in accordance with the movement tracked in step (d).

8. A method as in claim 1, further comprising repeating steps (b) and (c).

9. A method as in claim 1, wherein step (b) is stopped before step (c) begins.

* * * * *